United States Patent [19]

Baker

[11] 4,146,937

[45] Apr. 3, 1979

[54] PERIMETER SKIMMING GUTTER WITH FLUID LEVEL-RESPONSIVE WEIR CLOSURE FOR WEIR SKIMMING FLOW CONTROL

[76] Inventor: William H. Baker, 30 Honeysuckle Woods, Clover, S.C. 29710

[21] Appl. No.: 818,625

[22] Filed: Jul. 25, 1977

Related U.S. Application Data

[63] Continuation-in-part of Ser. No. 579,997, May 22, 1975.

[51] Int. Cl.[2] ..... E04H 3/16; E04H 3/20; E02B 7/20

[52] U.S. Cl. ..... 4/172.17; 210/169; 405/96

[58] Field of Search ..... 4/172.15, , 172.17, 4/172.18, 172; 210/169; 137/409, 429; 61/22 R, 25, 27, 28

[56] References Cited

U.S. PATENT DOCUMENTS

| | | | |
|---|---|---|---|
| 2,616,266 | 11/1952 | Hale | 61/25 |
| 3,316,934 | 2/1967 | Sowers | 210/169 |
| 3,543,521 | 12/1970 | Aubert | 61/25 |
| 3,668,713 | 6/1972 | Baker | 4/172.17 |
| 3,739,585 | 6/1973 | Dubouchet | 61/25 |
| 3,792,499 | 2/1974 | Whitaker | 4/172.17 |

*Primary Examiner*—Stuart S. Levy

[57] ABSTRACT

A perimeter skimming gutter for swimming pools is provided including a gutter conduit for disposition about the perimeter of a swimming pool and adapted to carry water at a level below a predetermined level of water in the swimming pool; a retaining wall on the pool side of the conduit over the top of which wall water may flow from the pool into the gutter conduit; a weir flow passage providing a fluid flow connection between the pool and at least one gutter conduit, entering the pool through the retaining wall at a level below the top thereof; and a fluid level responsive buoyant weir closure in the weir flow passage; a flow restricton in the weir flow passage confining normal weir flow through the weir flow passage to the gutter conduit to a predetermined maximum, the flow restricton blocking flow in excess of the predetermined maximum and thereby increasing fluid level in the weir flow passage between the weir closure and the pool; the weir closure responding to increasing weir flow passage fluid level to close off the weir flow passage at a predetermined level above the normal weir flow level.

19 Claims, 5 Drawing Figures

PERIMETER SKIMMING GUTTER WITH FLUID LEVEL-RESPONSIVE WEIR CLOSURE FOR WEIR SKIMMING FLOW CONTROL

This application is a continuation-in-part of Ser. No. 579,997 filed May 22, 1975.

All swimming pools have to be provided with one or more water inlets and water outlets. When the pool has a recirculating water system, it is conventional to build at least one of the water outlets in the form of an overflow or spillover. This may be associated with a skimmer, which utilizes the outlet flow to skim off surface debris and direct from the pool.

In many cases, the overflow or skimmer outlet is not in continuous operation and is open only when the pool is not in use, such as overnight, after the swimmers have left the pool for the day. For such purposes, a gate weir whose gate is manually opened and closed suffices to control the flow of water through that outlet or skimmer.

Nowadays, not all pool owners enjoy the chore of opening and closing a gate weir or skimmer and, accordingly, a number of devices have been provided to do so automatically. Typical devices of this type are described in U.S. Pat. No. 2,579,304 dated Dec. 18, 1951 to Crawford, U.S. Pat. No. 2,701,235 dated Feb. 1, 1955 to King, U.S. Pat. No. 3,316,934 dated May 2, 1967 to Sowers, and U.S. Pat. No. 3,428,178 dated Feb. 18, 1969 to Nash. These weirs are float-operated. The skimmer is operatively connected to a float which rides on the surface of the water in a skimmer pocket into which the outlet leads. The float rises or falls, depending upon the level of the water in the skimmer pocket, and carries the gate with it as it does so. The water circulation pump is arranged to take up the water flow from the outlet, and when the water circulation pump is started up, the level of water in the pocket is lowered, and the weir gate tips down, so water cascades over the weir. This flow continues while the pump continues to operate. When the pump ceases, the water level within the skimmer pocket rises to the same level as the water level in the pool, and so the float rises up with it, turning the weir to the closed position in which it serves as a barrier against return to the pool of debris within the skimmer pocket.

Over the years, swimming pools with perimeter gutter systems have come into widespread use, and these present special skimming problems. One type of perimeter gutter provides for flow of water over the top of the gutter wall into the gutter trough at all times. This provides a most efficient continuous skimming action under the usual water flow conditions, but as soon as swimmers enter the pool, or a heavy surge or wave action is encountered, the additional flow of water over the top of the gutter tends to flood the gutter, after which all skimming action is lost. In fact, some of the dirt already in the gutter may even be washed back. Such a gutter system is described in U.S. Pat. No. 2,932,397 dated April 12, 1960 to Ogden. An older system of different design is described in U.S. Pat. No. 1,797,397, dated March 24, 1931, to Booraem et al.

It has been suggested in U.S. Pat. No. 3,363,767 dated Jan. 16, 1968, to Ellis, that this condition can be alleviated if one or more skimming weirs are incorporated in the gutter at a lower level, below the top of the gutter. In this system, when the pool is not in use, the skimming weir is fully opened, and the skimming is obtained via the gutter but a lower level than the top of the gutter.

When the pool is in use, the skimming weir is closed, and the water level is held down below the lip of the gutter, providing a reserve in-pool surge capacity, and helping to avoid a flooded gutter condition at the time of flow surges.

It has been suggested in U.S. Pat. No. 3,155,989 to Miller Anderson that the skimming action can be adjusted to flow requirements if the weir gate is arranged to float on the level of water in the weir flow passage. Then, according to the level of water in the passage, the gate either rises or falls, and since the skimming flow from the pool is over the top of the gate, the level of the pool is correspondingly increased and skimming flow either increased or decreased. Thus, if the level of water in the gutter becomes excessively high, the gate weir rises and skimming flow is slowed or temporarily cut off. When the level of water in the gutter decreases, the gate weir descends with that level and the skimming flow increases. This provides a degree of compensation for abnormally high levels of water in the gutter. However, this system also is subject to loss of skimming action when the flow of water over the top of the gutter tends to flood the gutter, because when the gutter level is higher than the pool level, flow through the gate weir either ceases or flows in the opposite direction. In fact, in order to prevent back flooding from the gutter through the weir passages to the pool, under conditions of high activity, it is necessary for Miller Anderson to provide a protective cover which either restricts or prevents flow through the weir slots under such conditions. Thus, this system is not capable of retaining skimming action under conditions of high pool activity.

Baker, U.S. Pat. No. 3,668,713, patented June 13, 1972, provides a fluid flow and/or fluid pressure responsive gate weir for swimming pools comprising, in combination, a weir support; a fluid flow passage in the support; a gate member pivotably mounted in the support across the passage between flow-open and flow-closed positions; a gate control means disposed to encounter a fluid flow through and/or fluid pressure in the passage above a predetermined minimum, and responsive to such flow and/or pressure to pivot the gate member from a flow-open towards a flow-closed position; and means arranged to retain the gate member in the flow-open position under normal conditions of fluid flow and/or fluid pressure through the weir passage, and to permit pivotal movement of the gate member towards a flow-closed position while such excessive fluid flow and/or fluid pressure continues.

Means can also be provided to return the gate member to the flow-open position when such excessive flow and/or pressure subsides, and/or returns to normal.

This type of gate weir can be mounted in or across any kind of water outlet, to close the outlet under conditions of excessive flow and/or pressure, above a predetermined minimum, originating in the pool, however caused, and to reopen the outlet when flow and/or pressure returns to normal, or below the predetermined minimum. It can be in a skimmer opening, for example, and will be responsive to any excessive fluid flow and/or fluid pressure, such as arises from a flow surge, or an increase in fluid level of the pool, due to swimmers entering the pool, to close the skimmer opening, and keep it closed while the condition continues. As soon as the water level or surge has subsided, the gate member can be pivoted towards the open position, opening the skimmer, and permitting the normal skimming action to resume. This response can be repeated as often as necessary, in response to flow surges or waves, and in between the weir will still maintain a skimming action when possible under normal conditions. The gate weir is responsive only to pool-originating surges. It is not designed to close if there occurs an excessive gutter level or flow.

In accordance with the invention, a fluid level responsive buoyant weir closure is provided, especially designed for use with swimming pools having one gutter, but also useful in swimming pools with double gutters, so as to cut off flow through the weir passage under conditions of high pool activity.

One embodiment of weir flow assembly of the invention comprises, in combination, a weir support, a weir flow passage in the support, and a fluid level responsive buoyant weir closure member in the weir flow passage confining normal weir flow through the weir flow passage to the gutter conduit to a predetermined maximum, the flow restriction blocking flow in excess of the predetermined maximum and thereby increasing fluid level in the weir flow passage between the weir closure and the pool; the weir closure responding to increasing weir flow passage fluid level to close off the weir flow passage at a predetermined level above normal weir flow level.

In a swimming pool having first and second gutters, the buoyant weir closure member can be mounted across the weir flow passage in a manner to control flow into either the first gutter, or the second gutter, or both, from the pool, according to fluid level in the weir flow passage.

The invention further provides a nonflooding perimeter skimming gutter for swimming pools which permits an adequate skimming action through skimming weirs at times of low pool activity, and closes off the skimming weirs thereby providing an adequate surge capacity at times of high pool activity, without the possibility of gutter flooding, or dirt in the gutter being washed back into the pool, comprising a gutter conduit for disposition about the perimeter of a swimming pool and adapted to carry water at a level below a predetermined level of water in the swimming pool; a retaining wall on the pool side of the conduit over the top of which wall water may flow from the pool into the gutter conduit; a weir flow passage providing a fluid flow connection between the pool and at least one gutter conduit, entering the pool through the retaining wall at a level below the top thereof; and a fluid level responsive buoyant weir closure in the weir flow passage; a flow restriction in the weir flow passage confining normal weir flow through the weir flow passage to the gutter conduit to a predetermined maximum, the flow restriction blocking flow in excess of the predetermined maximum, and thereby increasing fluid level in the weir flow passage between the weir closure and the pool; the weir closure responding to increasing weir flow passage fluid level to close off the weir flow passage at a predetermined level above the normal weir flow level.

In a preferred embodiment, the perimeter skimming gutter includes a second gutter conduit which may be in fluid flow connection with the pool via the weir flow passage, or with the first gutter conduit, any such fluid flow connection entering the first gutter conduit at a level below the top of the retaining wall and adapted to drain off water from the first gutter conduit into the second gutter conduit at any level exceeding a predetermined maximum level therein so as to inhibit the level of water in the first gutter conduit from reaching the top of the retaining wall. The buoyant weir closure directs normal skimming flow into the second gutter conduit, but when this flow increases above a predetermined maximum, reflected in a corresponding higher water level in the weir flow passage before the weir closure, the weir closure in response to the higher water level rises and closes off the entry into the second gutter conduit from the weir flow passage.

The term "conduit" as used herein is inclusive of open conduits or troughs as well as partially or wholly enclosed conduits.

In a still more preferred embodiment of the invention, a water-feed conduit is provided in the gutter for feed of fresh water into the pool. This conduit is preferably an integral part of the perimeter gutter, and in the preferred embodiment of a twin-gutter system, the water feed conduit is disposed within, beside or beneath the second gutter conduit.

It is essential that the gutter level be below the swimming pool level, and the weir passage level at the swimming pool end, and that the buoyant weir closure member be responsive to an increase in fluid level above the normal skimming flow level in the weir flow passage to close off the weir flow passage. The weir closure member in the flow-open position can be at any level in the weir passage, but it is usually convenient to arrange it to be above the passage level at the swimming pool end, and to position it adjacent the gutter end of the weir passage, either in the weir passage or in the gutter.

The weir passage can be in two levels, an upper level at the swimming pool normal level for skimming flow, and a lower level below this, open to the gutter, and for example, at or above the normal gutter fluid level. Two such levels can meet at a stepped portion or ledge, but they can also be joined by an inclined portion. The weir closure member since it is buoyant or attached to a float rises along the step or ledge or inclined portion, to close off the weir passage there. A flow passage to a second gutter can be in or at the bottom of the step.

In a twin gutter system, the weir flow passage can include at the gutter outlet end, opposite to the pool inlet end, outlets to either or to both gutters, which latter outlets can serve as a flow communication between the gutters, and the weir closure member can move across the weir flow passage, so as to close off flow through the weir flow passage to either outlet, and put the gutters into flow communication with each other via the outlet connection therebetween.

The weir closure can be pivotably mounted in or across any kind of skimming flow pool weir flow passage, to close the passage at fluid levels in the weir flow passage above a predetermined minimum, however caused, and to reopen the weir flow passage when pool fluid level returns to normal, or below the predetermined minimum, It will be responsive to any excessive fluid level in the weir flow passage, such as arises from a flow surge, or an increase in fluid level of the pool, due to swimmers entering the pool. The weir closure in response thereto then closes the weir flow passage, and keeps it closed while the high condition continues. As soon as the water level or surge in the pool has subsided, the weir closure member returns to the open position, opening the weir flow passage, and permitting the normal skimming action to resume. This response is repeated as often as the high level occurs, in response to flow surges or waves, and in between the assembly via the flow weir passage will still maintain a skimming action when possible under normal conditions.

The weir flow passage fluid level responsive buoyant weir closure of the invention is also responsive to a temporary or extend increase in the water level of the pool that is reflected in an increase in water level in the weir flow passage, to close the weir flow passage, and permit the water level in the pool to rise above that, for example, to the top of the gutter. The weir will remain closed until the water level subsides.

Any degree of response to any increase in fluid level in the weir flow passage above a predetermined minimum due to surge action, wave action, or water level increase can be arranged for by the design of the buoyant weir closure member. A number of structural embodiments are contemplated.

In a preferred embodiment, the weir closure member is pivotably retained across the flow passage by mounting on a pivot pin attached to the weir support, so as to pivot between flow-open and flow-closed positions. In the flow-open position, the lower edge of the weir closure member with the floor of the weir defines the flow restriction in the weir flow passage, while the buoyant float is on the other side of the pivot mounting. Water backed up before the flow restriction reaches a level eventually where the float rises high enough to pivot the other end of the closure into a position closing off the variable size opening and closing the weir flow passage. In the flow-closed position, the sides and ends of the closure member seal against top, sides and bottom of the weir flow passage.

The flow restriction is sized to pass normal skimming weir flow. It can be a slot or orifice in the gutter wall through which the skimming flow passes. It can also be defined by the weir closure itself, in which event it is a flow opening of variable size, according to the level of fluid in the weir flow passage.

One form of float for the weir closure member is a hollow conduit, cylindrical, elliptical or polygonal in cross-section, with closed ends, such as a section of plastic or metal cylinder, tube or polygonal conduit. Another form is a foamed or cellular plastic or metal block light enough to float, i.e., displacing more than its own weight of water.

A buoy or float can also be in the form of a free-floating and sliding gate valve or plate that floats on end, confined within a cage or by a track, and that slides up and down with water level in the weir flow passage. This can move the weir closure member by a connecting lever arm.

A form of float is a gate of buoyant material, such as foamed plastic, or a sandwich sheet of hollow metal or plastic, confined to but riding free on the surface of fluid in the weir flow passage. Its buoyance thrusts the weir closure member pivotably down into a closed position whenever fluid level in the weir passage exceeds a predetermined level.

Another form of float is a hollow sandwich sheet that is rectangular or otherwise polygonal in cross-section, with closed ends, such as a hollow section of plastic or metal panelling, or a foamed plastic sheet light enough to float, i.e., displacing more than its own weight of water.

In all variations of the weir closure, the closure member is put at one end of a lever arm, and the weir float is put on the other side of the pivot mounting, on the other arm of the lever. The lever arms can be at 180°. To conserve space, the lever arms are preferably at an angle of less than 180°, and usually from 45° to 135°.

The buoyant weir closure member, weir control member, and support or housing, as well as other components, can be made of any desired material. Metals which are resistant to corrosion by water and weather are preferred, such as stainless steel, aluminum, anodized aluminum, galvanized iron and zinc, and porcelain- or ceramic- or glass-coated metals. The buoyant weir components can also be made of buoyant plastic material, such as foamed or cellular polytetrafluoroethylene, nylon, polyethylene, polypropylene, polycarbonates, polyoxymethylene, phenolformaldehyde, melamine-formaldehyde, urea-formaldehyde, polyallyl, polyester, and polyurethane resins.

A resilient flexible material can seal more tightly than a rigid one, and thus rubbery materials such as the natural and synthetic rubbers, and flexible plasticized plastics such as polyvinyl chloride, polyacrylonitrile and copolymers of terephthalic acid and ethylene glycol, can also be used.

The sealing edge of the weir closure member can be provided with a sealing gasket or ring, or the weir closure member can be arranged to seat against a sealing gasket or ring when in the closed position, to ensure a snug leak-tight fit when the weir closure member is closed.

The buoyant weir closure member of the invention can be used to control flow between two gutters in any twin gutter perimeter gutter system, such as for example any of these shown in U.S. Pat. Nos. 3,668,712, 3,668,713, 3,668,714 and 3,815,160 and 4,050,104. U.S. Pat. No. 3,668,713 describes a twin gutter system including a closed-top or covered gutter in or adjacent the pool retaining wall for skimmer water flow, and an open trough gutter on the other side of the pool retaining wall, for water spilling over the top of the pool retaining wall in the event of wave action or surges. A gate weir closes off the skimming water flow to both gutters in the event of a flow surge or wave from the pool side. Such twin gutters as shown in FIGS. 6, 7 and 8 of the patent keep skimmer water flow separate from gutter flow, and there is no way for the dirt washed out of the pool by skimming action and entering the closed gutter ever to be washed back into the pool in the event of wave action or surge flooding in the open gutter. Water in both gutters is led to the pool recirculation system, and normally fed back into the pool, and for this purpose a clean water feed conduit can be provided placed above, below or beside the covered gutter and/or the open top gutter, as shown in these Figures of the patent.

Preferred embodiments of the invention are illustrated in the drawings, in which.

Figure 4:
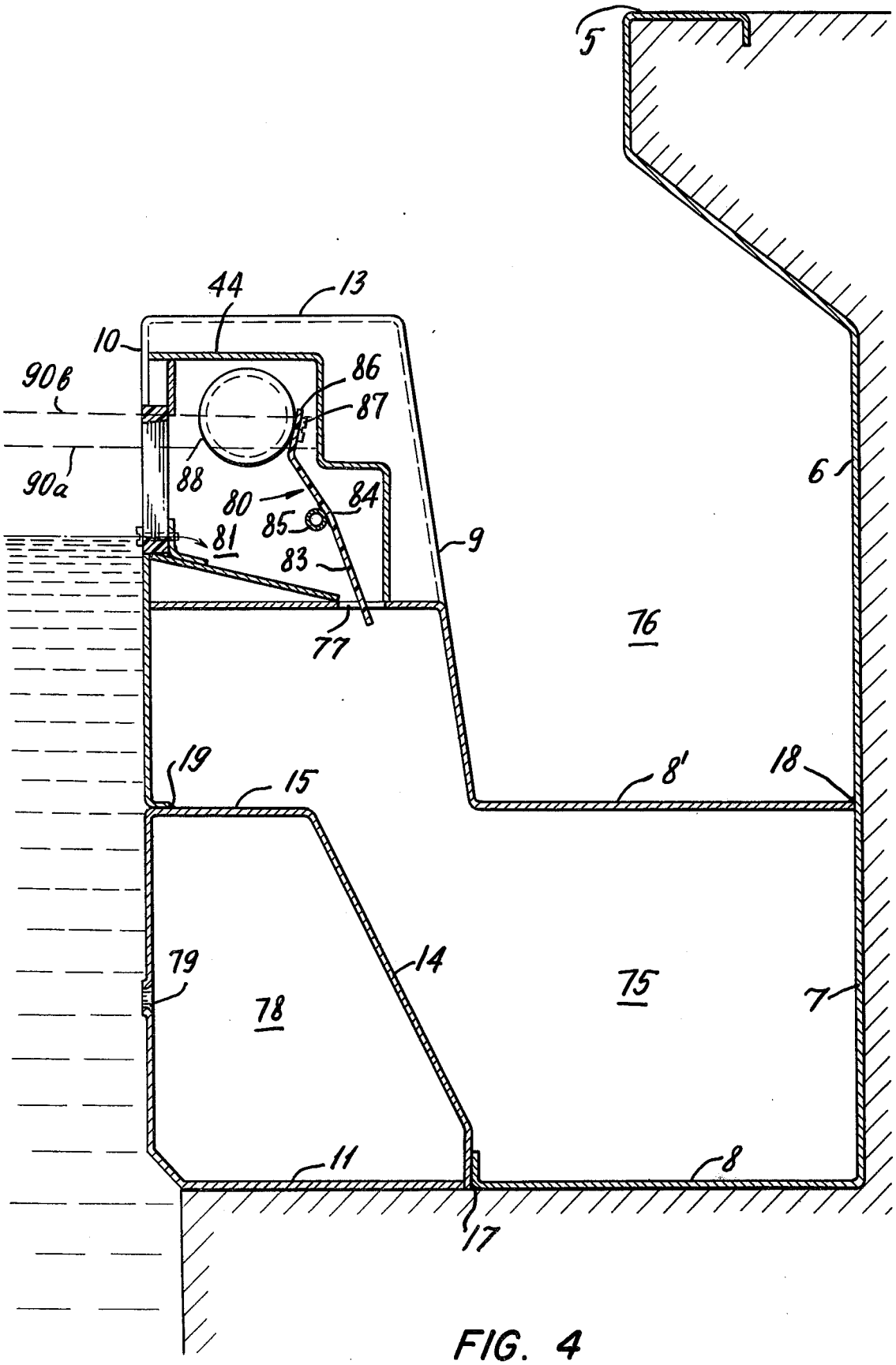
Figure 5:
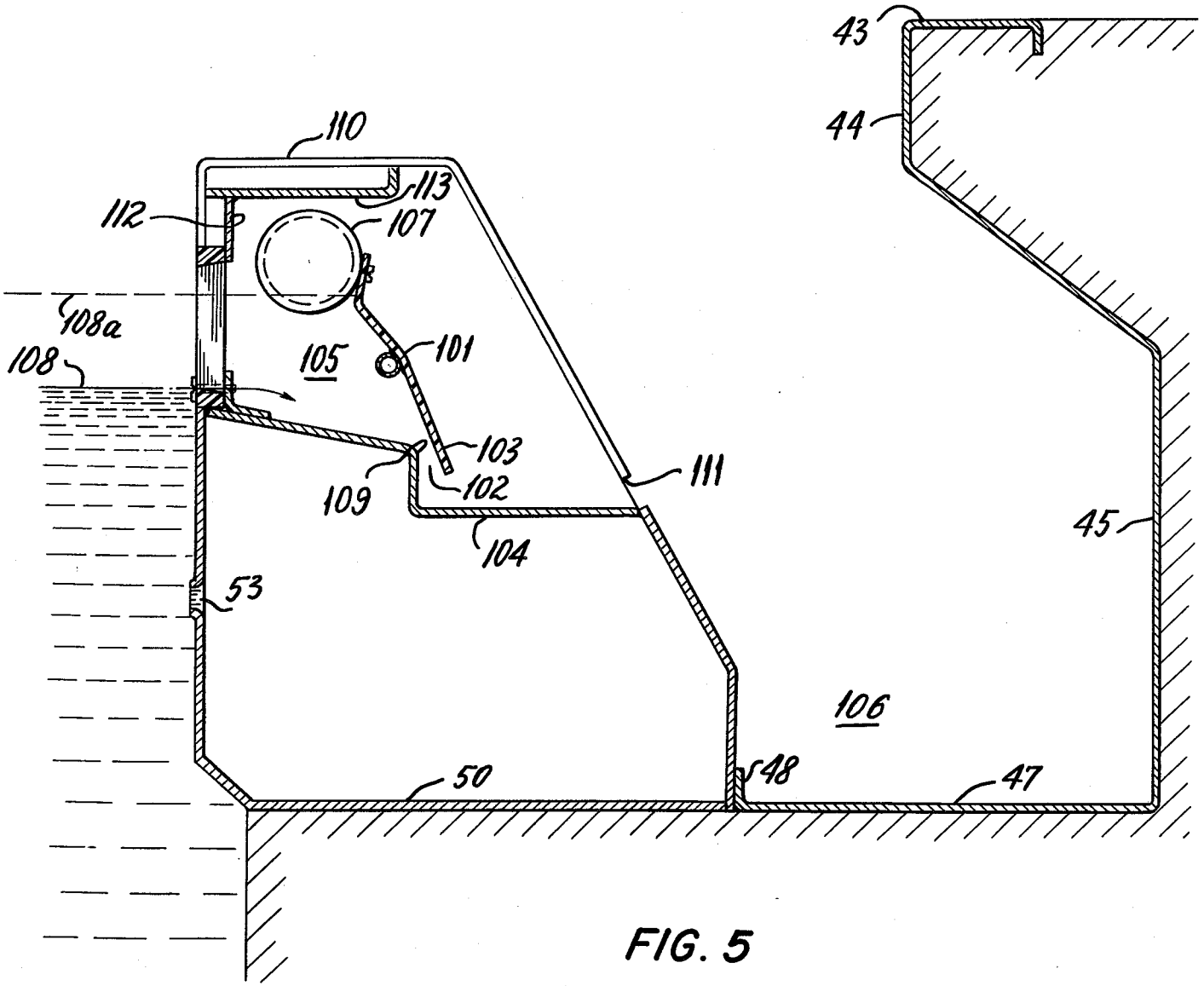

FIG. 4 represents a view in cross-section of another embodiment of double perimeter gutter of a swimming pool, provided with a through skimmer passage and first and second gutters, the skimmer passage including a buoyant weir closure in accordance with the invention, pivotably mounted for movement between open and closed positions across the weir flow passage, showing the weir closure in a weir-flow-passage-open position;

FIG. 5 represents a view in cross-section of another embodiment of weir closure member, in a single gutter swimming pool, showing the weir closure in the weir-flow-passage-open position.

Figure 1:
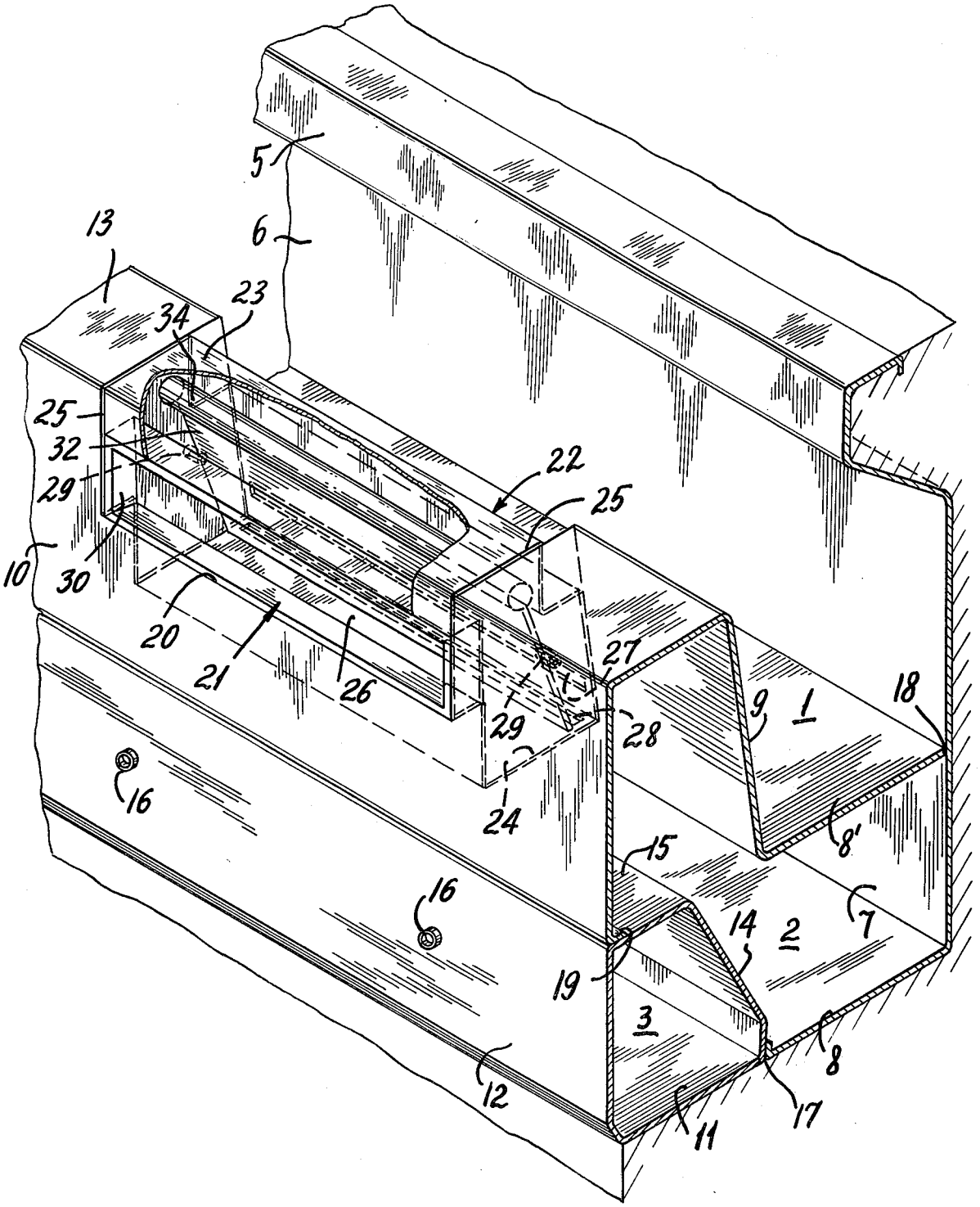
FIG. 1 represents a front view of a twin perimeter gutter of a swimming pool, provided with a through skimming weir flow passage and first and second gutters, the skimmer passage including a buoyant weir closure in accordance with the invention, pivotably mounted for movement between closed and variably open positions across the weir flow passage.
Figure 2:
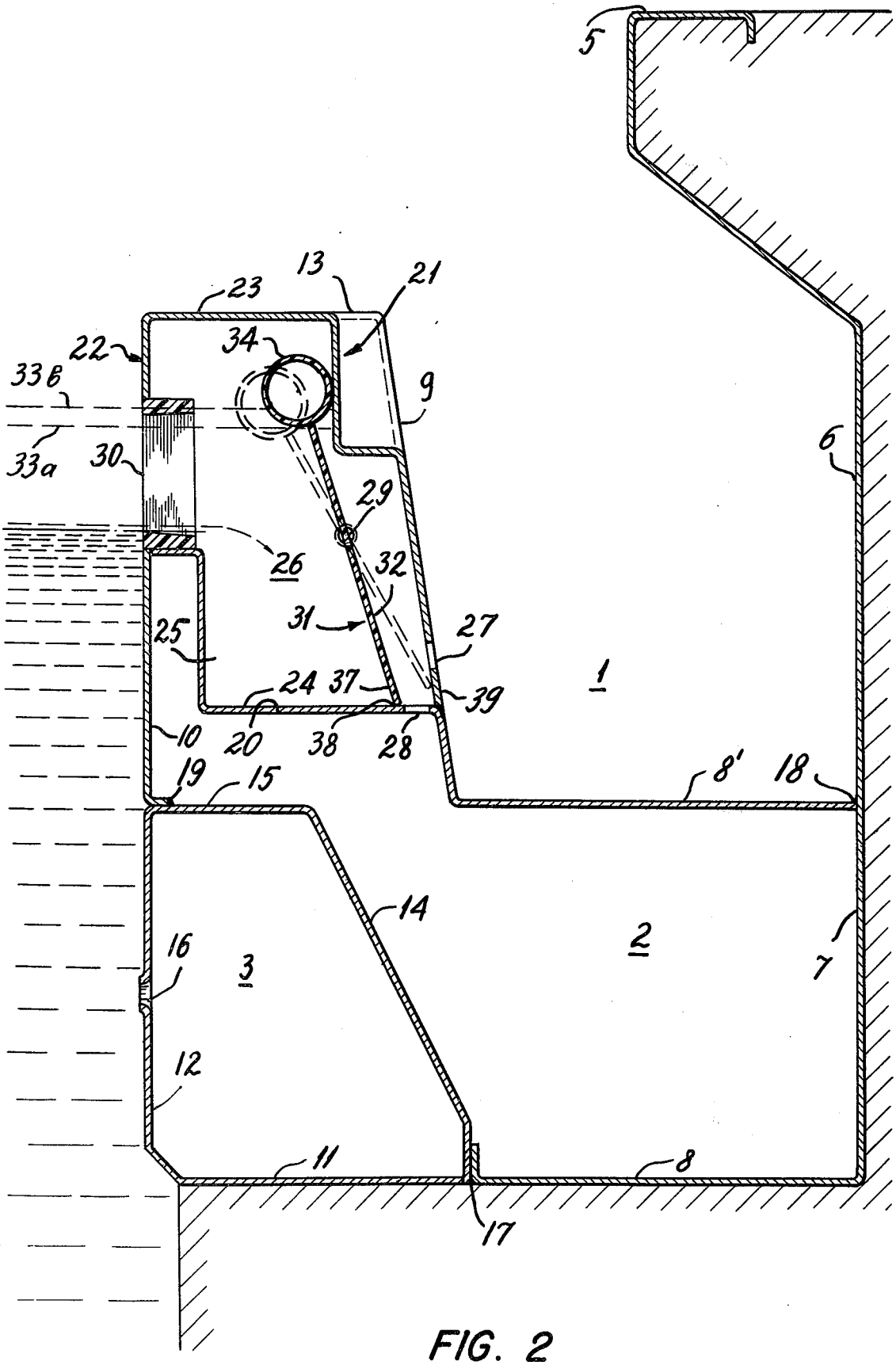
FIG. 2 represents a view in cross-section of the perimeter gutter and weir of FIG. 1, showing in solid lines the weir closure in the weir flow-passage-closed position, and in dashed lines the weir closure in the weir-flow-passage-open position.

The perimeter gutter shown in FIGS. 1 and 2 is made up of a number of modular gutter units, fitted together about the perimeter of the pool during construction of the pool, with the abutting ends being bonded together by welding, brazing or soldering. Each unit includes a first gutter conduit 1, a second gutter conduit 2, a water inlet feed inlet conduit 3, and a skimming weir assembly 21.

The first gutter conduit is in the form of an open trough, made of one sheet of stainless steel folded in the configuration shown in the Figures. The sheet forms a top coping 5 and the upstanding side 6 of the gutter trough 1, and the side 7 and bottom 8 of the second gutter conduit 2. Another sheet forms the bottom 11, the pool-side wall 12, the top wall 15 and the gutter-side wall 14 of the water feed conduit 3, and is welded to the first sheet at 17. A third sheet forms the pool-side wall 10 of the second gutter conduit 2 and the top 13 of the gutter, and the side wall 9 and the bottom 8' of the gutter trough 1, and is butt-welded to the first sheet at 18, and welded to the secnd sheet at 19.

The water feed conduit thus constitutes a bottom, a pool side, a top and a gutter side. Thus, the pool-side wall 12 of the water feed conduit 3 and the pool-side wall 10 of the second gutter conduit 2 serve as the pool-side retaining walls of the perimeter gutter. The wall 12 of the water feed conduit is provided with a number of openings 16 for flow of the fresh water into the pool at a level below the pool level at the top of the perimeter gutter.

In a cut out portion 20 of the second gutter conduit 2 is fitted a skimming weir 21, composed of a weir housing 22 whose top 23 is flush with the top 13 of the second gutter conduit 2, and which is provided with a bottom 24 and side walls 25. A weir flow passage 26 extends through the weir housing 22, from the retaining wall 10 to the first gutter 1 at opening 27, which is at a level below the skimming slot 30 in the pool-side retaining wall 10 at the beginning of the weir passage 26. A slot 28 connects the bottom 24 of the weir flow passage with the second gutter conduit 2. The slot 28 extends all the way across the flow passage 26. The level of the opening 30 while higher than the slot 27 is below the top of the buoyant weir closure 31. The weir closure 31 has a body 32 of water-impermeable sheet material, such as stainless steel or molded plastic, for example, polyethylene or polycarbonate, and is provided at one end with a polyvinyl chloride tubular float 34. This float is arranged to ride on the surface of the water in the weir flow passage 26, the skimming weir flow from the pool, while reaches the float when the level in the weir passage reaches level 33a.

Under conditions of normal flow, at or below level 33a, the water entering the weir flow passage 26 from the pool flows along the bottom 24 of the weir flow passage below the float portion 34 of the weir, and since in this position of the weir closure 31, shown in dashed lines in FIG. 2, such water can flow into the second gutter conduit via the slots 28, normal skimming flow is via the second gutter conduit through the slots 28 at the gutter end of the weir flow passage 26.

It will be apparent that with the weir closure 31 in the dashed line position shown in FIG. 2, access to the opening 27 is prevented, since the weir under the weight of the float 34 seals at its lower end against the wall 39. All skimming flow therefore must proceed through passage 26 below the weir closure 31, whence it reaches the second gutter conduit through the slot 28.

The weir closure is pivotally mounted at about its center of gravity to the sides 25 of the weir flow passage on the pivot pins 29, but float 34, acting as a counterweight, weighs it into the dashed line-open position shown in FIG. 2. A spring can serve the purpose of a counterweight and be attached to the body 32 of the weir closure in a manner to draw the closure into the open position, shown in dashed lines in FIG. 2, mounting one end of the spring of the body 32 and the other on the wall 39, for example. The weir closure can pivot freely in either direction on the pivot pins. When the water reaches level 33*a* in the weir flow passage, however, the float 34 rides on the surface of the water, and starts to rise, and eventually, at level 33*b*, brings the weir closure 31 into fluid-tight sealing engagement with the float 34 against the top 23 and the end portion 38 against the bottom 24 of the weir flow passage. In this position, the weir closure 31 closes off the weir flow passage 26. This closes off the slot 28 to direct flow of water from the pool into the second gutter conduit, and stops weir skimming flow. At the same time, movement of the weir closure opens the opening 27 connecting the gutter 1 with the gutter 2 via slot 28. Any surges, waves, and other excessive water flow from the pool cannot flow through the weir flow passage, but can proceed over the top 23 of the retaining wall into the first gutter 1, and the flow capacity of the gutter 1 is increased by the volume of the second gutter 2, because flow from the first gutter when the level reaches opening 27 can pass through opening 27 and slot 28 into the second gutter 2, preventing flooding of the first gutter.

Figure 3:
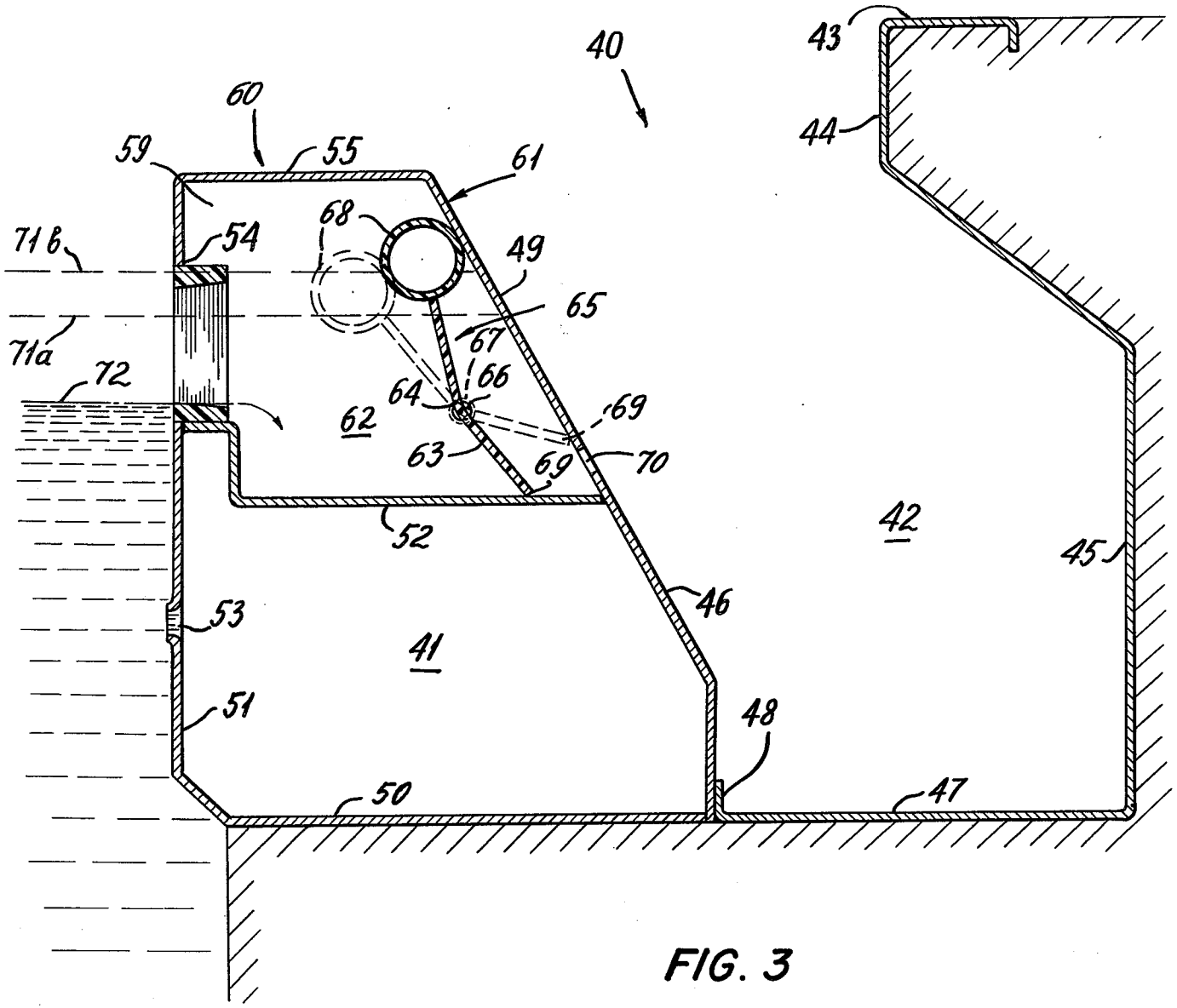
FIG. 3 represents a view in cross-section of a single perimeter gutter structure, showing in solid lines the weir closure in a weir-flow-passage-closed position, and in dashed lines the weir closure in a weir-flow-passage-open position.

The single perimeter gutter 40 shown in FIG. 3 has a pool-side clean water feed conduit 41 and a trough 42 on the other side thereof. The top wall 43 of the gutter serves as the edge coping at the top of the pool. This perimeter gutter is made up of a number of modular units 40, of which one is shown in FIG. 3, which are fitted together about the perimeter of the pool in the course of the construction of the pool, being bonded together at their abutting ends by welding, brazing or soldering. This gutter is formed of a sheet of stainless steel, which is shaped with the top 43 and side 44 serving as the coping about the perimeter of the pool, and the open trough portion 42 formed with upstanding sides 45, 46 and a bottom 47. The side 46 is in fact made up of three sections, bonded together by welding, a lower flange 48 extending upwardly from the bottom 47 of the gutter trough 42, the side 46 of the closed water feed conduit 41, and the side 49 of the weir support 61.

The conduit 41 has a bottom 50, an upstanding pool-side wall 51, with water feed inlets 53, and a top 52. The pool-side wall 51 serves as a retaining wall for the pool water. The wall 51 of spaced modular units 40 about the pool side contains a number of narrow, substantially horizontal slot 54 spaced around the pool, in which is snugly fitted, in a press fit, and bonded, if desired, by brazing, welding or soldering, or by an adhesive or synthetic resin bonding agent, a stainless steel skimming weir 60. Each weir comprises a weir support 61 with a weir flow passage 62 and a weir closure member 65. Water flowing through the skimmer flow passage 62 flows into the gutter 42 through slot 70, and water flowing over the top 55 of the gutter also enters the gutter 42.

The modular design makes assembly on-site easy, since all modular units 40 can be provided with slots 54, and the weir support 61, and associated parts are fitted in those to carry the skimmers, while the others are closed off. This also facilitates servicing, replacement, or repair of weir units during the life of the pool.

The weir closure 65 has a body 63 of plastic sheet such as polyvinyl chloride or stainless steel bent in a wide V-shape; pivotably mounted at the bend 64 on an axle 66, which rotates in bearing sockets 67 in the side walls 59 of the passage 62. The closure 65 at its top carries a cylindrical float 68 made of a section of hollow plastic pipe such as polyvinyl chloride closed off at each end. The body 63 is long enough and heavy enough with float 63 to balance the closure in the position shown in dashed lines, with its bottom edge 69 sealed against wall 49 of the weir support. In this position, slots 70 are exposed, and skimming flow from the pool can enter gutter 42 from the passage 62 in the slots.

The slots are large enough to pass normal skimming weir flow, but not flow appreciably in excess of normal flow, above a predetermined maximum. When such flows are reached, they are backed up by the slots into the weir flow passage 62, and the water level rises. When the level indicated by line 71a is reached, float 68 begins to rise, and when the water level in the passage 62 reaches level **71*b*, the float moves to the solid line position shown in FIG. 4, and the bottom edge 69 of the closure seats against the bottom 52 of the passage 62, and the weir flow passage 62** is closed.

In operation, at the normal skimming flow level in the weir flow passage, the weir closure 65 is in the dashed line position, well above normal level at 72. If flow increases beyond the normal pool level 72 to level **71*a*, such as due to a wave or surge, or a large number of swimmers entering the pool at one time, it encounters the float 68 and at level 71*b* the closure 65 swings up to the solid-line position shown in FIG. 3, to close off the passage 62, and is held there by water level in the passage. When the water level subsides, the float 68 returns the closure 65 to an open position, where it is held by the weight of the float 68**.

This design has the advantage that the closure closes in response to a surge in the pool before the gutter level rises, and remains closed until the pool level subsides, and/or until the gutter level subsides, reserving the full gutter capacity for surge flow over the top 60 of the gutter.

Thus, during normal flow, the skimmer action is provided by the weir flow passage 62, such water entering the passage 62 and gutter 42, and being fed back through the pool recirculating system by way of the filter and pump to the water feed intake for the pool. When swimmers enter the pool, the water level may rise to the above-normal pool level **71*b*, in which event the closure 65 closes, and skimming action halts until any excessive water flow passage level subsides. An adequate in-surge flow capacity is provided by the additional height of the wall 49 between the weir and the top 55 of the conduit 41. Wave action or surges beyond the predetermined maximum flow over the top 55 into the gutter 42**, whence the water is again carried by way of the pool recirculation system back to the pool.

The perimeter gutter system shown in FIG. 4 in similar to that of FIGS. 1 and 2. The perimeter gutter includes a first gutter trough 76 and a second gutter conduit 75, combined with a skimming weir system that feeds skimming weir flow via slot 77 into the second gutter 75, with a pivotable buoyant weir closure 80 controlling flow from the skimmer passageway 81 directly into the gutter 75. The slot 77 is narrow, and passes only normal skimming weir flow. When weir flow rises above normal, it backs up in passage 81, and the water level in the passage rises. When the level reaches **90*a*, the float 88 starts to rise, and slot 77 narrows further. This backs up more water, and when the passageway 81 fills with water to level 90*b*, the closure 80 closes the weir passageway 81. Gutter 76 serves as a reserve gutter for surges and waves flowing over the top 13 of the perimeter of the pool, while closure 80 prevents return of such flood water to the pool via the passageway 81. Both gutters 75, 76 return water to the filters and recirculation system, whence clean water is fed to the pool via clean water feed conduit 78 and nozzles 79**.

It will be noted that the gate weir closure 80 has a sheet body 83 which is bent at a small angle at 84, and pivots on pin 85. At the upper end of body 83 is a flap 86 to which is attached by screws 87 a tube 88 of plastic such as polyvinyl chloride.

The single perimeter gutter system shown in FIG. 5 has a weir closure that seals against a ledge in the floor of the weir flow passage. In the at-rest or normal position, with weir flow at pool level 108, the closure is weighted so that the float 107 rests against the inner wall 112 at the opening into the weir flow passage 105, and the lower edge 103 is well above skimming weir flow through the passage. When the pool level reaches **108*a*, the float 107 and closure 101 are buoyed up, into the position shown in solid lines in FIG. 5. In this position, the weir closure 101 narrows the slot 102 between its lower edge 103 and the bottom 104 of weir flow passage 105. While water can continue to flow from the pool via weir flow passage 105 and slot 102 into the gutter trough 106, the slot 102 still only allows normal skimming weir flow to pass. Any flow in excess of this backs up in passage 105. If the level of water rises above level 108a, the weir float 107 rises also, further narrowing the slot 102, so that the level of water then rises more quickly, and eventually carries the float high enough to bring the lower edge 103 into sealing engagement with the bottom 104 at ledge 109, and float 107 seals against the skimmer top 113, closing off the passage 105. Thus, the skimmer flow passage is closed to return flow from the gutter trough 106** to the pool.

All water flooding over the top of retaining wall 110 into the gutter trough 106 now has the full flow capacity of the gutter trough in which to be collected, and drawn off to the water recirculation system. Thus, an adequate gutter capacity is provided, and the washing back of dirt and contaminants into the pool via the weir flow passage is prevented.

The perimeter gutters and weir shown in the drawings are made of stainless steel, but it will, of course, be understood that other metals can be used, such as galvanized iron and steel, and aluminum, as well as anodized aluminum. Whatever the metallic material, its surface should be treated so as to render it corrosion-resistant, as by plating, galvanizing, anodizing, porcelain-enamel coating, or painting. It is also possible to form the perimeter gutter and/or the weir of plastic material, either in whole or in part. There are plastics now available which are sufficiently strong to withstand the weir and tear of a perimeter gutter system, including, for example, acrylonitrile-butadiene-styrene resin, polycarbonate resin, polytetrafluoroethylene, polyvinyl chloride, polyvinylidene chloride, polyesters, polypropylene, polyamides, and synthetic rubbers such as polyisoprene, polybutadiene, butadiene-styrene copolymers, and butadiene-isoprene copolymers.

The preferred construction is from a sheet or several sheets of metallic of plastic material, which are formed into the desired configuration, as is seen in the cross-sectional drawings. It is usually preferred that the coping portion at the top rear of the perimeter gutter extend at least partially, and preferably wholly, across an open gutter trough, so as to prevent people from stepping or falling into the gutter. Such can also be prevented by covering the gutter with a grating or grid of metal or plastic, the same or different material from the gutter.

The use of modular units, such as are shown in the drawings is preferred, because this permits mass production of the gutter and weir system at a point remote from the swimming pool, with easy and inexpensive transportation from that point to swimming pool construction sites anywhere in the world. The modular units can then be assembled on site to form any type or configuration of swimming pool, and any desired weir arrangement. The modular units can be made in straight sections for rectangular of other straight-sided pool shapes, while curved sections can be made for pear-shaped, elliptical, circular, or other curved-side pool configurations.

The modular units can be fitted together by welding, soldering or brazing, in the case of metal units; by bonding, using various types of adhesives, in the case of metal or plastic units; or by heat-sealing, ultrasonic welding, or heat-bonding, in the case of thermoplastic plastic units. Plastic units which are not fully heat-cured can be bonded and then cured in situ to form a permanent bond on site, in the course of construction of the pool.

The perimeter gutter and weir system of the invention can be used completely around the perimeter of a pool, or only partially around the pool perimeter, as desired. The most uniform skimming action and gutter action is, of course, obtained when the entire perimeter of the pool is provided with such a gutter and weir.

While construction of the gutter and weir in the form of modular units has been described, it will also be appreciated that the gutter and weir system can be formed on site in the configurations shown using concrete or plastic material, and can form an integral part of the pool wall, by casting or pouring into suitable frames, so that the material can harden and set in the desired pool and skimmer outlet shape. The construction of the gutter system is sufficiently simple so that this type of technique can be employed with good results. Since this requires more hand-work, however, and is therefore a more costly method of construction, it would not usually be preferred, particularly in the case of large pools, where construction costs may be too high to permit the luxury of a hand-made gutter system on the pool site.

The gutter and weir system can also be made from bricks or tiles, which are built up in the desired configuration. These can be the usual types of materials, preferably with a ceramic facing, so that it is leak-proof, with the tiles being bonded together with water-resistant adhesive or cement.

The swimming pool can be equipped with water filtration and cleaning recirculation systems. The gutters usually feed water therein to such systems by gravity. Pumps can be provided, and the gutters can also be provided with jet water inlets to direct a driving flow of water along the gutter, to flush out the gutters, and to drive water along the gutter towards the water recirculation system. Such jet water inlets are described in U.S. Pat. No. 2,932,397 to Ogden, dated April 12, 1960.

Other variations and modifications of the invention will be apparent to those skilled in the art.

Having regard to the foregoing disclosure, the following is claimed as the patentable and inventive embodiments thereof:

1. A skimming weir assembly for use in a perimeter retaining wall of a swimming pool having at least one gutter conduit about the perimeter of the swimming pool and adapted to carry water at a level below a predetermined level of water in the swimming pool, comprising a weir housing; an enclosed weir flow passage having enclosing walls and providing a confined fluid flow connection between the pool and at least one gutter conduit said passage entering the pool through the retaining wall at a level below the top thereof; a flow restriction in the weir flow passage defining maximum weir flow through the weir flow passage; a fluid level responsive buoyant weir closure movable according to water level in the weir flow passage between a position at a high water level in which it engages at least one wall and closes the passage to flow, and a position at a lower water level in which it is away from such engagement and opens the passage to flow, and disposed in the weir flow passage between the pool and the flow restriction; and means to retain the weir closure in the flow-open position at the lower water level corresponding to normal weir flow; the flow restriction blocking flow in excess of the normal weir flow and thereby backing up water and increasing water level in the weir flow passage from the flow restriction back to the weir closure; and the weir closure buoyantly responding to such increasing water level to rise into engagement with at least one wall and close off the weir flow passage at a predetermined water level above the level corresponding to normal weir flow.

2. A skimming weir assembly according to claim 1, in which the weir closure comprises a gate having a float at one end, and a closure at the other end, and is pivotably mounted therebetween for swinging movement about a central axis to pivot the closure between closed and open positions.

3. A skimming weir assembly according to claim 2, in which the gate is pivotably mounted so that the portion including the float is heavier than the portion including the closure, so as to retain the closure portion normally in the flow-open position.

4. A skimming weir assembly according to claim 3, in which the float is carried above normal weir flow level, and is reached only by abovenormal weir flow level.

5. A skimming weir assembly in accordance with claim 1, in which the retaining means returns the weir closure to the flow-open position when such above-normal flow level subsides or returns to normal.

6. A skimming weir assembly in accordance with claim 1, in which the means to retain the weir closure in the flow-open position comprises a counterweight.

7. A skimming weir assembly in accordance with claim 1, in which the means to retain the weir closure in the flow-open position comprises a float.

8. A skimming weir assembly according to claim 1, in which the swimming pool has first and second gutter conduits, and the weir closure projects into a junction of weir flow passage outlet end, an outlet therefrom to the first gutter, and an outlet therefrom to the second gutter, and pivots across the junction in manner to put the weir flow passage in flow communication with said gutter in an open position, and close the weir flow passage in the closed position while leaving the first and second gutters in flow communication with each other via the junction.

9. A perimeter skimming gutter in accordance with claim 1, comprising a clean water feed conduit connecting with at least one water inlet opening through the retaining wall leading to the pool.

10. A perimeter skimming gutter in accordance with claim 9, in which the feed conduit is closed at the top, and the gutter trough is open.

11. A perimeter skimming gutter for swimming pools comprising at least one gutter conduit for disposition about the perimeter of a swimming pool and adapted to carry water at a level below a predetermined level of water in the swimming pool; a retaining wall on the pool side of the conduit over the top of which wall water may flow from the pool into the gutter conduit; an enclosed weir flow passage having enclosing walls and providing a confined fluid flow connection between the pool and at least one gutter conduit, entering the pool through the retaining wall at a level below the top thereof; a flow restriction in the weir flow passage defining maximum weir flow through the weir flow passage; a fluid level responsive buoyant weir closure movable according to water level in the weir flow passage between a position at a high water level in which it engages at least one wall and closes the passage to flow, and a position at a lower water level in which it is away from such engagement and opens the passage to flow, and disposed in the weir flow passae between the pool and the flow restriction; and means to retain the weir closure in the flow open position at the lower water level corresponding to normal weir flow, the flow restriction blocking flow in excess of the normal weir flow and thereby backing up water and increasing liquid level in the weir flow passage from the flow restriction back to the weir closure; the weir closure bouyantly responding to such increasing water level to use into engagement with at least one wall and close off the weir flow passage at a predetermined water level above the level corresponding to normal weir flow.

12. A perimeter skimming gutter in accordance with claim 11, comprising a second gutter conduit in fluid flow connection with the pool via the weir flow passage.

13. A perimeter skimming gutter in accordance with claim 12, in which the weir flow passage is also in fluid flow connection with the first gutter conduit at a level below the top of the retaining wall, the fluid flow connection when the weir closure is closed being adapted to drain off water from the first gutter conduit into the second gutter conduit at any level exceeding a predetermined maximum level therein so as to inhibit the level of water in the first gutter conduit from reaching the top of the retaining wall.

14. A perimeter skimming gutter in accordance with claim 11, in which the gutter is an open trough, and comprising an open grid extending over the gutter trough.

15. A perimeter skimming gutter in accordance with claim 11, in the form of a modular unit adapted to be assembled end-to-end with other such units to form the perimeter gutter of a swimming pool.

16. A swimming pool comprising side walls and a bottom adapted to retain water therewithin, and, extending about the upper perimeter of at least a portion of one side wall thereof, a perimeter skimming gutter in accordance with claim 11.

17. A swimming pool in accordance with claim 16, including a water cleaning and recirculating system for collecting water flowing into and along the gutter trough, cleaning it, and returning it to the pool.

18. A swimming pool in accordance with claim 16, in which the water cleaning and recirculating system includes a water filter for cleaning the water and a water pump for returning the clean water to the pool.

19. A perimeter skimming gutter for swimming pools which permits an adequate skimming action at all times, and also provides for an adequate surge capacity when the pool is in use, without the possibility of the gutter's flooding, or dirt in the gutter's being washed back into the pool, comprising a first gutter conduit at the pool perimeter; a second gutter conduit at the pool perimeter, in fluid flow connection with the first gutter conduit and adapted to receive water from the first gutter conduit whenever the level of the water in the first gutter conduit exceeds a predetermined maximum, established at the level of the fluid flow connection therebetween; a retaining wall of the pool side of the first gutter conduit over the top of which wall water may flow from the pool into the first gutter conduit; an enclosed weir flow passage having enclosing walls, extending through the pool-side retaining wall at a level below the top of the wall, and providing a confined fluid flow connection with both the first and the second gutter conduits; a flow restriction in the weir flow passage defining maximum weir flow through the weir flow passage; a fluid-level responsive buoyant weir closure disposed in the weir flow passage between the pool and the flow restriction and movable according to water level in the weir flow passage between a first position in the weir flow passage at a low water level in which it engages at least one wall of the weir flow passage, closing off the fluid flow connection to the first gutter conduit and directing weir passage flow into the second gutter conduit, and a second position at a high water level in which it also engages at least one wall of the weir flow passage and closes off the fluid flow connections from the weir flow passage to both the first and second gutter conduits, and directing flow from the first gutter into the second gutter; and means to retain the weir closure in the first position at a low water level corresponding to normal weir flow; the flow restriction blocking flow in excess of the normal weir flow and thereby backing up water and increasing water level in the weir flow passage from the flow restriction back to the weir closure, and the weir closure buoyantly responding to such increasing water level to rise into engagement with at least one wall in the second position at a predetermined water level above the level corresponding to normal weir flow; the top of the pool-side retaining wall being spaced above the weir flow passage at a height to retain the pool water within the pool perimeter at water flows, wave actions and surges up to a predetermined minimum, while allowing excessive flows, wave actions and surges beyond such minimum to flow over the top of the wall into the first gutter conduit.

* * * * *

UNITED STATES PATENT AND TRADEMARK OFFICE

CERTIFICATE OF CORRECTION

PATENT NO. : 4,146,937
DATED : April 3, 1979
INVENTOR(S) : William H. Baker

It is certified that error appears in the above-identified patent and that said Letters Patent are hereby corrected as shown below:

| | | |
|---|---|---|
| Abstract, line 12 | : | "restricton" should be --restriction-- |
| line 15 | : | "restricton" should be --restriction-- |
| Column 1, line 7 | : | Insert --now abandoned-- after "May 22, 1975" |
| Column 4, line 55 | : | " , " should be -- . -- |
| Column 5, line 3 | : | "extend" should be --extended-- |
| Column 6, lines 49-50 | : | "and-/or" should be --and/or-- |
| Column 7, line 67 | : | "while" should be --which-- |
| Column 10, line 8 | : | "in" should be --is-- |
| Column 12, line 66 | : | "abovenormal" should be --above-normal-- |
| Column 13, line 46 | : | "passae" should be --passage-- |

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*